United States Patent [19]

Goldfarb

[11] Patent Number: 4,483,900

[45] Date of Patent: Nov. 20, 1984

[54] POLYTETRAFLUORETHYLENE-POLYURETHANE COATED FABRIC

[75] Inventor: Ralph Goldfarb, Huntington, N.Y.

[73] Assignee: Oakwood Industries, Inc., Huntington Station, N.Y.

[21] Appl. No.: 398,653

[22] Filed: Jul. 15, 1982

[51] Int. Cl.[3] ..... B32B 7/00

[52] U.S. Cl. ..... 428/262; 427/392; 427/393.4; 428/264; 428/265; 428/267; 428/290; 428/334; 428/421; 428/422; 428/423.1; 428/913

[58] Field of Search ..... 428/264, 265, 267, 290, 428/913, 421, 422, 423.1, 262, 334, 423.5, 423.7; 524/507; 427/392, 393.4

[56] References Cited

U.S. PATENT DOCUMENTS 2,976,257 3/1961 Dawe et al. ..... 524/507

*Primary Examiner*—James J. Bell

*Attorney, Agent, or Firm*—Lackenbach Siegel Marzullo Presta & Aronson

[57] ABSTRACT

A fabric is produced by coating a synthetic substrate fabric with a milled combination of 75 parts fully reacted polyurethane and 25 parts polytetrafluorethylene (PTFE), which product fabric has a large plurality of pores of about 0.2–0.3 microns, and provides high levels of thermal and vapor transmission through the fabric while being highly water repellent. The present fabric is useful in a single ply application for a wide range of apparel and camping goods.

30 Claims, No Drawings

POLYTETRAFLUORETHYLENE-POLYURETHANE COATED FABRIC

FIELD OF THE INVENTION

This invention relates to a synthetic fabric. Specifically this invention relates to a coated fabric.

BACKGROUND AND DISCUSSION OF THE PRIOR ART

In the synthetic fabric field it was desired to provide protective and outerwear apparel fabrics which were water-proof, breathable, and highly abrasion resistant.

To achieve that result the prior art was directed to multiple ply bonded combinations of fabrics, wherein each individual fabric ply contributed one or more of the desirable properties, namely, water-proofness, breathability and abrasion resistance.

In U.S. Pat. No. 3,953,566, granted Apr. 27, 1976, and U.S. Pat. No. 4,187,390, granted Feb. 5, 1980, both to Gore, it was proposed to provide a porous PTFE sheet, which PTFE sheet was then bond laminated often as a middle layer between a nylon outer fabric and a light weight tricot inner fabric to provide an outerwear apparent fabric. Such laminated fabrics would not, however, wash or dry clean well, inasmuch as the laminate bond would weaken and break, particularly so in dry cleaning.

Now there is provided by the present invention a one ply fabric sheet which achieves commercially acceptable levels of water-proofness, breathability, abrasion resistance and dry cleanability.

It is therefore a principal object of the present invention to provide a novel coated fabric and formulation and method for providing said coated fabric.

It is another object of the present invention to provide a single ply fabric which is commercially acceptable and competitive with multiple ply fabrics, particularly so in outerwear applications.

It is another object of the present invention to provide a coated fabric as aforesaid which provides a combination of desired outerwear apparel properties, including without limitation, water-proofness, breathability, good hand, abrasion resistance and dry cleanability.

It is still a further object of the present invention to provide a coated fabric as aforesaid which is readily produced and suitable for a broad range of outerwear uses, and other uses where there is extensive exposure to the elements.

DESCRIPTION OF THE PREFERRED EMBODIMENTS

In one aspect the present invention may be stated as being a substrate fabric being coated with a composition comprising a mixture of polyurethane and polytetrafluoroethylene (PTFE) dispersed throughout the polyurethane, and wherein the polyurethane is present in a predominant amount.

In another aspect, the invention may be broadly stated as a formulation for and a method of coating a substrate fabric by:

(a) combining a formulation comprising;

| Component | Parts by weight (range) |
|---|---|
| polyurethane (solids) | 10–20 |
| polytetrafluorethylene (solids) | 3–8 |
| polymeric suspension agent | 1–5 |

-continued

| Component | Parts by weight (range) |
|---|---|
| organic solvent | 20–50 |

(b) coating a layer of the step (a) formulation on a substrate web; and (c) evaporating the solvent from the coated layer to form a fabric sheet that repels water droplets while transmitting water vapor thereto so as to be both water repellent and breathable.

In carrying out the present invention, small particulates of PTFE are physically blended with and interdispersed between polyurethane particulates. The particulates are high sheared or milled to a fine degree, specifically 7+ on the Hegman scale. To assist in the blending dispersion, certain high molecular weight polymers have been added, particularly those selected from a long chain polyamino-amide, a high molecular weight acid ester, and a polycarboxylic acid.

A typical general formulation for the coating useful pursuant to the present invention is Formula (I) as follows:

| Component | Parts by weight (range) |
|---|---|
| polyurethane (solids) | 10–20 |
| polytetrafluorethylene (solids) | 3–8 |
| polymeric suspension agent | 1–5 |
| organic solvent | 20–50 |

A typical specific coating formulation useful in the present invention in Formula (II) as follows:

| | Parts by weight |
|---|---|
| Base Polymer | |
| Polyester-based Polyurethane, 30% solids solvated isoproproponol:toluol 1:1 | 50.00 (15.00 dry solids) |
| Polytetrafluorethylene (PTFE) | 5.00 |
| Pigment | |
| Dry pigment | 3.75 |
| Substrate Bonding Agent | |
| Toluene diisocyanate (TDI) | 2.25 |
| Suspension Agents | |
| Long chain polyamino-amides | 0.95 |
| High molecular weight acid ester | 0.55 |
| Polycarboxylic acid | 0.50 |
| Solvent | |
| Isopropanol | 16.00 |
| Toluol | 16.00 |
| Total | 100.00 |

It is important that the ratio of polyurethane solids: PTFE solids be from about 2:1 to 4:1, and preferably about 3:1.

It is preferred that the formulation include a substrate bonding agent which serves to improve the bond between the PTFE-polyurethane coating and the substrate fabric. Typically, di- and polyisocyanates have been found useful in this regard, and toluene diisocyanate (TDI) is most preferred.

As previously stated, suspension agents such as high molecular weight polymers including polyamino-acids, high molecular weight acid esters, and polycarboxylic acids are added to assist in the suspension of the PTFE particulates in the polyurethane. The dispersion or suspension agents should generally have molecular weights in the range of 500 to 1,500.

In the practice of the present invention, a composition as per Formula (II) is wet milled to fine particulates of at least about +7 on the Hegman scale. The milling operation may be maintained at below about 70° C. as elevated temperatures have been found to be unnecessary. The milled formulation is then applied to a release web or paper in about 1 mil thickness. The layer is dried in a step-wise zone heating of between 50° C. and 120° C. for about two minutes overall. A second formulation layer of 0.5 mils is then applied to the first layer, and the substrate fabric (e.g. nylon) is nip-rolled so that the formulation coats and in part impregnates the substrate layer. The coated fabric is then zone dried in a manner similar to aforesaid, and then the release paper is peeled away. Coatings of about 1 to 3 mils, and 1 to 1.5 mils have been found useful.

It is to be borne in mind that a broad range of coating techniques may be employed in the present invention, including floating knife, knife over roller, knife over rubber blanket, reverse roll coater, gravure roller, air knife, curtain coating, direct coating, transfer coating and laminating.

The fully coated fabric was found to surprisingly have a high plurality of relatively small pores or orifices of from about 0.1 to 0.5 microns and preferably 0.2 to 0.3 microns. This is in contrast to prior art polyurethane coatings which exhibited pores having sizes in the range of 2 to 3 microns. The decrease in pore size with the increase in the number of pores is believed to improve both the breathability and waterproofness of the product, while the dispersed PTFE improves the abrasion resistance, when compared with prior art polyurethane coatings. Without wishing to be bound by any theory or mechanism, it is believed that by maintaining the fine PTFE particulates in dispersion between the polyurethane particulates, the pore size range, as well as other properties are achieved.

In addition the coated fabric product was found to be fully dry cleanable, and machine washable, was washfast and possessed light stable colors.

To demonstrate the level of achievement present in the coating itself, a composition of Formula (II) was applied to a release paper and force dried through a 4-zone oven, so as to be subjected to heat zones of 50° C., 65° C., 90° C. and 120° C. in seriatim for an overall period of about two minutes. The resultant polymeric layer was peeled away from the release paper, and tested to have the following physical properties:

100% Modulus: 1,100 psi
300% Modulus: 3,200 psi
Ultimate Tensile: 5,500 psi
Ultimate Elongation: 380%
Tear: 380 psi
Hydrolytic Stability: 2 weeks exposure at 75° C. and 95% relative humidity, 115% retained properties.

It is of course understood that the comparison may be varied to achieve desired levels of properties for any specific application.

A broad range of fabric substrates is contemplated including both natural and synthetic fabrics and combinations thereof, e.g., nylon, tricot, polyester, cotton, polycot and the like.

Both polyether and polyester polyols can be employed in preparing the polyurethane. Any suitable polyols may be used for this purpose. These polyols usually have a hydroxyl number, for example from about 25 to about 800.

The organic polyisocyanates used in the preparation of the polyurethane include, for example, toluene diisocyanate, such as the 80:20 and the 65:35 mixture of the 2,4- and 2,6-isomers, ethylene diisocyanate, propylene diisocyanate, methylene-bis-4-phenyl isocyanate, 3,3'-bitolune-4,4'-diisocyanate,, polymethylene polyphenylisocyanate, mixtures thereof, and the like. The preferred organic polyisocyanates are toluene diisocyanate and 4,4' diphenyl methane diisocyanate. The amount of isocyanate employed in the process of this invention should be sufficient to provide at least about 0.7, and preferably about 0.9 to 1.20, NCO groups per hydroxyl group present in the reaction system for complete reaction.

The PTFE that has been found useful in the present invention, is the commercial grade of PTFE solid lubricant, which was generally commercially used as a grease additive. A typically preferred PTFE grease additive is the Whitcon series, ICI Americas, Inc., Wilmington, Del. 19897. (Whitcon" is a registered trademark of ICI Americas, Inc.) Another preferred PTFE lubricant additive is Fluon L169, ICI Americas, Inc., Stanford, Conn. 06904, ("Fluon" is a registered trademark of ICI Americas, Inc).

Useful solvents in the present formulation include by way of example aklyl and aryl monohydric and dihydric alcohols, such as 1-propanol, isopropanol, toluol, and the like.

Various additives may also be included in the mixtures which serve to provide different properties in the polyurethane. For example, fillers such as clay, calcium sulfate, or ammonium phosphate may be added to lower cost and improve physical properties. Ingredients such as dyes may be added for color, and fibrous glass, asbestos, or synthetic fibers may be added for strength. In addition, plasticizers, deodorants, antioxidants, and flame retardants may be added.

The finished fabric of the present invention is useful in a broad range of applications such as, by way of example, apparel (e.g., outerwear), protective clothing, leatherlike fabrics, shower-proof fabrics, raincoats, ponchos, recreational wear, gloves, shoes, boots, leggings, sneakers, (e.g., running shoes), handbags, belts, sleeping bags, tents, tarpaulins, travel-wear, furniture upholstery and automotive upholstery.

While there has been described a coated fabric which is commercially acceptable and useful as a single ply, it is understood that other fabric layers may be used in combination with the fabric layer of the present invention where desired.

It will thus be seen that the objects set forth above, among those made apparent from the preceding description, are efficiently attained, and since certain changes may be made in carrying out the above process, in the described product, and in the embodiments set forth without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A coated fabric comprising a base fabric having a coating comprising a composition comprising the combination of polyurethane and polytetrafluoroethylene (PTFE) and a polymeric suspension agent, wherein the polyurethane is present in a predominant amount on a dry weight basis, said coated fabric having pores so as to repel water droplets while transmitting water vapor so as to be both water repellent and breathable.

2. The fabric of claim 1, wherein the coated fabric comprises pores of about 0.1 to 0.5 microns.

3. The fabric of claim 2, wherein the polyurethane to PTFE weight ratio is from about 2:1 to 4:1.

4. The fabric of claim 3, wherein the coating is from about 1 to 3 mils in thickness.

5. The fabric of claim 4, wherein the coated fabric consists of a single fabric ply, and repels water droplets while transmitting water vapor there through so as to be both water repellent and breathable.

6. The fabric of claim 5, wherein the polyurethane to PTFE ratio is about 3:1.

7. The fabric of claim 6, wherein the pore size range is from about 0.2–0.3 microns.

8. The fabric of claim 7, said polymeric suspension agent being one selected from a polyamino-amide, a high molecular weight acid ester and a polycarboxylic acid.

9. A composition for coating a fabric sheet comprising:

| Component | Parts by Weight (Range) |
|---|---|
| polyurethane (solids) | 10–20 |
| polytetrafluorethylene (solids) | 3–8 |
| polymeric suspension agent | 1–5 |
| organic solvent | 20–50 |

said coated fabric having pores so as to repel water droplets while transmitting water vapor so as to be both water repellent and breathable.

10. The formulation of claim 1, said suspension agent comprising at least one selected from a long chain polyamino-acide high molecular weight acid ester and a polycarboxylic acid, said selected agent having a molecular weight of 500 to 1,500.

11. The formulation of claim 10, wherein the polyurethane is fully reacted.

12. The formulation of claim 11, further comprising an isocyanate bonding agent.

13. The formulation of claim 12, wherein the polytetrafluorethylene solids are suspended in and dispersed between the polyurethane solids.

14. A method for making a coated fabric comprising;

(a) combining a formulation comprising;

| Component | Parts by weight (range) |
|---|---|
| polyurethane (solids) | 10–20 |
| polytetrafluorethylene (solids) | 3–8 |
| polymeric suspension agent | 1–5 |
| organic solvent | 20–50 |

(b) coating a layer of the step (a) formulation on a substrate web; and (c) evaporating the solvent from the coated layer to form a coated fabric having pores so as to repel water droplets while transmitting water vapor thereto so as to be both water repellent and breathable.

15. The method of claim 14, wherein step (a) is by milling or high shearing.

16. The method of claim 14, wherein the product of step (a) is at least 7+ on a Hegman gauge.

17. The method of claim 14, wherein the formulation during step (a) is maintained at a temperature below about 70° C.

18. The method of claim 14, further comprising cooling after step (a) and before step (b).

19. The method of claim 18, wherein the evaporating is step-wise between about 50° C. and 120 C., for about 2 minutes overall.

20. The method of claim 19, wherein the coated fabric comprises pores of about 0.1 to 0.5 microns.

21. The method of claim 20, wherein the coating is about 1 to 3 mils in thickness.

22. The method of claim 21, wherein the polyurethane to PTFE ratio is about 3:1.

23. The method of claim 22, wherein the pore size range is from about 0.2–0.3 microns.

24. The method of claim 23, wherein the polyurethane is fully reacted.

25. The method of claim 14, wherein the polyurethane is fully reacted.

26. The method of claim 25, further comprising an isocyanate substrate bonding agent.

27. The method of claim 26, wherein the polytetrafluorethylene solids are suspended in and dispersed between the polyurethane solids.

28. The method of claim 27, wherein the pore size range is from about 0.2–0.3 microns.

29. The method of claim 28, wherein said suspension agent comprising at least one selected from a long chain polyamino-acid, a high molecular weight acid ester and a polycarboxylic acid, said selected agent having a molecular weight of 500 to 1,500.

30. The method of claim 29, further comprising cooling the combined formulation to about 25° C. prior to coating.

* * * * *